US005323677A

United States Patent [19]

Knutson

[11] Patent Number: 5,323,677

[45] Date of Patent: Jun. 28, 1994

[54] PICK FOR PLUCKING STRINGED MUSICAL INSTRUMENTS

[76] Inventor: John A. Knutson, P.O. Box 945, Forestville, Calif. 95436

[21] Appl. No.: 45,210

[22] Filed: Apr. 13, 1993

[51] Int. Cl.[5] ..... G10D 3/16

[52] U.S. Cl. ..... 84/322; D17/20

[58] Field of Search ..... 84/322; D17/20

[56] References Cited

U.S. PATENT DOCUMENTS

| | | | |
|---|---|---|---|
| 401,476 | 4/1889 | Barnes | 84/322 |
| 413,579 | 10/1889 | Stewart | 84/322 |
| 566,806 | 9/1896 | Shearer | 84/322 |
| 1,296,284 | 3/1919 | Gilman | 84/322 |
| 1,444,982 | 2/1923 | Orth | 84/322 |
| 2,016,438 | 10/1935 | Kealoha | 84/322 |
| 2,045,571 | 6/1936 | Dopyera | 84/322 |
| 3,650,172 | 3/1972 | Osborne | 84/322 |
| 3,739,681 | 6/1973 | Dunlop | 84/322 |
| 3,927,595 | 12/1975 | Ferguson | 84/322 |
| 4,741,239 | 5/1988 | Crafton | 84/322 |
| 4,879,940 | 11/1989 | Pereira | 84/322 |

FOREIGN PATENT DOCUMENTS

| | | | |
|---|---|---|---|
| 2433338 | 1/1976 | Fed. Rep. of Germany | 84/322 |

*Primary Examiner*—Russel E. Adams
*Assistant Examiner*—Cassandra C. Spyrou
*Attorney, Agent, or Firm*—Dalton L. Truluck

[57] ABSTRACT

An improved easily attachable and easily removable pick to be worn over the end of a finger for the purpose of plucking the strings of a stringed musical instrument. The pick comprises a picking element or artificial nail worn over the natural nail and conforming closely to the size, shape and contour of the natural nail. The artificial nail is held in place over the natural nail by a closely fitting, thin, flexible securement sleeve which extends from the fingertip almost to the first joint of the finger. The close conformity of the artificial nail to the natural nail imparts optimal sensitivity and natural feel to the player of the instrument.

17 Claims, 1 Drawing Sheet

PICK FOR PLUCKING STRINGED MUSICAL INSTRUMENTS

FIELD OF THE INVENTION

This invention relates to a pick for plucking the strings of musical instruments. More specifically, the invention concerns an improved pick of the type which is worn on the end of an instrumentalist's finger to take the place of the natural fingertip or fingernail for plucking. Although the pick of the present invention is especially useful in conjunction with guitars, banjos, ukuleles and mandolins, it has utility with other stringed instruments as well.

BACKGROUND OF THE INVENTION

Musical instruments having strings which are plucked with the fingertips or fingernails have been in use since ancient times. When the fingertips are used for plucking, severe discomfort to the player often results in that the fingers become sore and tender, and sometimes blisters even occur. Similarly, when the fingernails are employed for plucking, they wear down quickly and frequently crack, chip, split or break, all of which requires a considerable length of time for regeneration for the average player. The advent of steel strings has aggravated these problems. Because of these troubles associated with use of the natural fingertips or fingernails for plucking, picks to serve as substitutes for the human fingertips and fingernails were long ago devised.

Two principal kinds of picks evolved. One is a type which is grasped between the player's fingers, and the other is a type which is worn directly on the end of a player's fingers. It is this latter type with which the present invention is concerned.

Many varieties of finger-worn picks have been devised, and a large number have been patented. In fact, inventors have been patenting finger-worn picks in the United States for well over one hundred years in an attempt to achieve a pick which will retain the basic sound and natural feel of the human fingertip or fingernail. However, in all that time no completely satisfactory finger-worn pick has been developed.

There are numerous requirements which must be met to achieve a completely satisfactory finger-worn pick. In particular, such pick must have good sensitivity and natural feel, must be easy for the player to attach to the finger and equally easy to remove, must have positive and facile lengthwise alignment and positioning on the finger, must stay in place even under conditions of forceful play, and must be capable of allowing both upstroke and downstroke picking. In addition, the pick must be durable, composed of few parts, comfortable to the wearer and cause minimal distraction to the player.

Although, as mentioned previously, many designs and varieties of finger-worn picks exist in the prior art, none has fulfilled all of the above-mentioned requirements. Indeed, judging by the models currently on the market, no finger-worn pick exists which comes close to meeting those requirements. Hence, there has been a long-felt need to attain a finger-worn pick for plucking the strings of stringed musical instruments which meets all of the foregoing requirements and at the same time is economical both from a manufacturing standpoint and a purchasing standpoint.

DISCUSSION OF THE PRIOR ART

In spite of the fact that finger-worn picks have long been known and are available in many styles, all such picks so far devised suffer from one or more deficiencies, thus rendering them unsuitable or undesirable for one reason or another.

One of the most notable deficiencies of prior art finger-worn picks is the inability thereof to impart a natural feel and sensitivity to the player. This drawback is due chiefly to failure of the picking element of prior art finger-worn picks to conform closely to the shape of the natural nail and to bear directly against the natural nail to the requisite extent. It has been discovered by the inventor that only when a finger-worn pick is constructed in this manner will it have the feel and sensitivity of the natural nail.

Another major deficiency of prior art finger-worn picks is the failure thereof to stay in place on the finger. This problem is especially pronounced in picks which are made so as to be adjustable for fitting on fingers of different size. When a pick is made in this manner, it requires constant repositioning and tightening in order to keep it in the proper playing position. Obviously, if the pick becomes loose and shifts position on the finger while playing, the instrumentalist has great difficulty completing the musical selection which is being played at the time. Also, picks which are adjustable are generally difficult to attach to the finger to begin with, and, in addition, are usually uncomfortable to the wearer.

Further, many prior art finger-worn picks do not permit both upstroke and downstroke picking, thus limiting the player's plucking style and preference.

Attention is now directed to the following United States patents which disclose finger-worn picks typical of the several varieties of prior art finger-worn picks which have been produced. These patents serve to corroborate the numerous drawbacks of prior art picks enumerated above.

| | | |
|---|---|---|
| Barnes | 401,476 | April 16, 1889 |
| Stewart | 413,579 | October 22, 1889 |
| Shearer | 566,806 | September 1, 1896 |
| Gilman | 1,296,284 | March 4, 1919 |
| Orth | 1,444,982 | February 13, 1923 |
| Kealoha | 2,016,438 | October 8, 1935 |
| Dopyera | 2,045,571 | June 30, 1936 |
| Osborne | 3,650,172 | March 21, 1972 |
| Dunlop | 3,739,681 | June 19, 1973 |
| Crafton | 4,741,239 | May 3, 1988 |
| Pereira | 4,879,940 | November 14, 1989 |

None of the picks disclosed in these patents has sufficient sensitivity or natural feel to serve as a satisfactory substitute for the natural fingertip or fingernail because not a single one of these picks has the necessary extent of contact with the top surface of the natural nail. In this respect, the picks of Barnes, Shearer, Orth, Kealoha and Dopyera only contact a minor portion of the top surface of the natural nail, and the picks of Gilman and Dunlop do not contact the top surface at all. As to Stewart, the picking element itself, that is, the part C, does not contact the natural nail but is separated therefrom by the thimble element A. Similarly, the picking element 3 of Crafton is spaced from the natural nail by the intervening strap 1 and as a result sensitivity and natural feel is severely diminished. Lastly, although both Osborne and Pereira illustrate and describe finger-worn picks having picking elements which are shaped to follow the curvature of the natural nail, those picks still fall short of providing optimal sensitivity and natural feel because when installed on the finger they do not contact substantially the entire upper surface of the natural nail. Rather, they contact only a limited portion of the top surface of the natural nail. In this regard, observe FIG. 4 of Pereira wherein it can be seen that the part 10 contacts only about one-half of the upper surface of the natural nail, and FIG. 1 of Osborne wherein it is shown that part 10, even though contoured like the natural nail, nevertheless actually contacts the natural nail only near the rear thereof.

Another significant drawback of the picks of Barnes, Stewart, Shearer, Gilman, Orth, Kealoha, Dunlop and Pereira is that they do not stay in place while playing and therefore require constant repositioning and tightening. This is due to the adjustable nature of these picks which are made so as to fit fingers of different size. On the other hand, the picks of Dopyera and Osborne, while staying in place fairly well, are uncomfortable to the wearer. The pick of Osborne is especially objectionable in this respect because the wire type securing element pinches the finger and the clip 14 which engages beneath the fingernail either exerts an undesirable pulling force on the fingernail during upstroke picking or digs into the tip of the finger during downstroke picking.

Still other disadvantages and deficiencies of the finger-worn picks shown in the listed patents exist, but the specific examples just given are sufficient to point to the need for an improved finger-worn pick.

OBJECTS AND SUMMARY OF THE INVENTION

It is the principal object of the invention to provide a finger-worn pick which has sensitivity and feel approximating the natural human fingernail.

Another object of the invention is to provide a finger-worn pick which is easy to attach and, once attached, remains in place even under conditions of forceful playing and whether used for upstroke or downstroke picking, all while providing for full range of motion.

A further object of the invention is to provide a finger-worn pick which is comfortable to the wearer.

Another object is to provide a finger-worn pick the nail of which can be cut, trimmed and filed to a particular shape much the same as a human nail.

Still other objects of the invention are to provide a finger-worn pick which is simple to produce and has few parts.

These and other objects are accomplished by a finger-worn pick constructed of but two parts: a picking element having the general shape and contour of a human fingernail, and a securement element in the form of a circumferentially continuous annular flexible sleeve to which the picking element is permanently attached. The sleeve has a length approximately the length of the distal phalange of a human finger and is tailored to the size of an individual finger so that when placed thereon will fit snugly and remain in place. The picking element is made of a material which is harder than a human fingernail and has a rounded forward picking edge protruding outwardly beyond the fingertip end of the sleeve a distance sufficient to permit plucking of the strings of a stringed musical instrument.

DETAILED DESCRIPTION OF THE INVENTION

Figure 1:
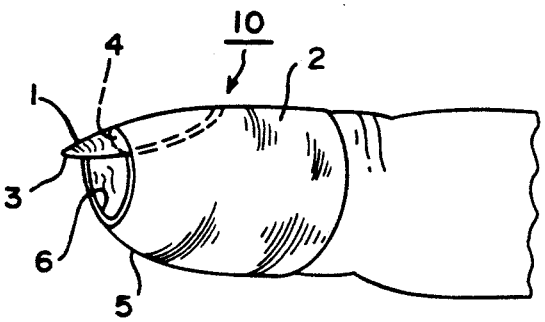
FIG. 1 is a side view of the pick shown attached to the end of a finger in its position of use.
Figure 2:
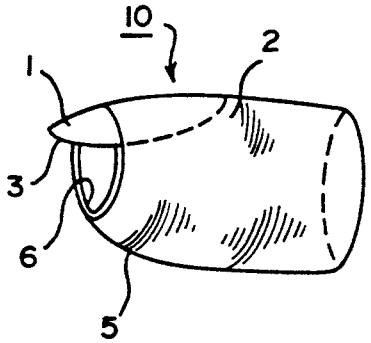
FIG. 2 is a perspective view of the pick.
Figure 3:
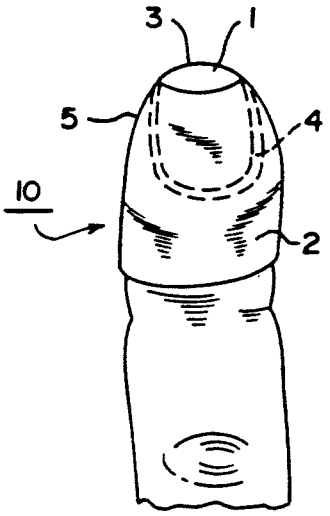
FIG. 3 is a top view of the pick shown attached to the end of a finger.
Figure 5:
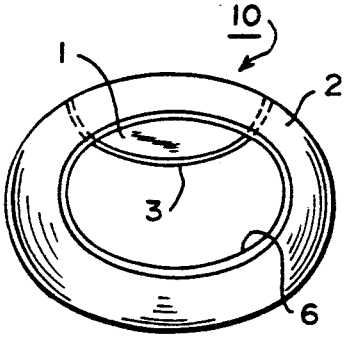
FIG. 5 is a frontal view of the pick.
Figure 4:
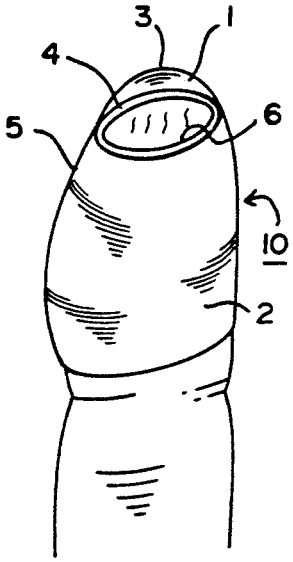
FIG. 4 is a bottom view of the pick shown attached to the end of a finger.

As shown in the several drawing figures, the pick of the invention, designated in its entirety by the numeral 10, consists of two parts: namely, the picking element 1 and the securement element 2.

The picking element 1 is in the form of an artificial nail and has a complex curvature such that its upper surface is convex in shape and its lower surface, which is to contact the natural nail 4 in use, is concave. The picking element or artificial nail is made of a material harder than a human fingernail and has a rounded forward picking edge 3 which extends beyond the picking edge of the natural nail 4 when in use, thereby providing a durable striking edge for string actuation. In all other respects the picking element or artificial nail 1 closely follows the general size and shape of the natural nail 4. In this regard, the picking element further includes a rounded rear edge and side edges connecting the rounded forward picking edge 3 with the rounded rear edge. By virtue of this construction, the picking element can conform closely to and cover substantially the entire top surface of the natural nail, with the side edges and rounded rear edge fitting down into the depression formed by the ridge of skin around the sides and the cuticle area of the natural nail and giving the closest possible contact with the natural nail. This extremely close contact is essential in order to optimally disperse the torqueing pressure motion caused by plucking a string over the whole surface of the natural nail and thereby achieve optimal sensitivity, natural feel, and dynamic picking control for the player. The picking element can be made out of any suitable material, such as a plastic, a composite, or metal, the only requirements being that the material be harder and more durable than the human fingernail.

The securement element 2 is in the form of a circumferentially continuous annular flexible sleeve having a length approximately the length of the distal phalange of a human finger and having a fingertip end 5 and an opposite end with an opening of a size to receive the end of a human finger. The fingertip end 5 of the sleeve 2 is rounded, as shown in the drawing, to conform to the shape of the tip of the finger as well as to provide a positive stop to limit the insertion of the finger. This construction enables accurate and facile lengthwise alignment of the artificial nail 1 with the natural nail 4. In addition, such construction gives rise to a snug fit of the sleeve upon the finger and minimizes the need for adjustments and repositioning.

In its preferred form the sleeve includes an opening 6 cut into the central area of the rounded fingertip end 5. The opening 6 allows the fingertip to contact the string for a tactile reference to increase accuracy and picking control.

The artificial nail or picking element 1 is permanently affixed to the securement element 2 by bonding a portion of its convex upper surface to the internal surface of the sleeve such that the rounded forward picking edge 3 protrudes outwardly beyond the fingertip end of the sleeve a distance sufficient to permit plucking the strings of a musical instrument. Bonding can be effected by gluing the two parts together or by such other techniques as solvent bonding, sonic bonding, thermoplastic bonding, or the like. However, whichever technique is employed, care must be taken to maintain the concave lower surface of the picking element 1 entirely exposed so that it can directly contact substantially the entire top surface of the natural nail 4. In other words, there must be no part of the sleeve 2 or any other material whatsoever between the undersurface of the artificial nail 1 and the top surface of the natural nail 4 when the pick 10 is in place on the finger. This requirement is critical in order to attain maximum sensitivity and optimum natural feel.

The sleeve 2 is made of a thin, strong, and flexible material such as a plastic and is tailored to the size of an individual finger. To this end, sleeves are produced in increments of about 1/16 inch radius to provide the best possible fit and frictional grip with fingers of different sizes. The preferred manufacturing process for the sleeve comprises shrinking plastic heat-shrink tubing over various sizes of round-ended finger forms which conform to the dimensions and general shape of human fingers. After removal from the form, the opening 6 is cut into the central area of the rounded end of the sleeve, if such opening is desired. Then the picking element or artificial nail 1 is bonded to the sleeve using any of the techniques mentioned above. In the instance when an opening 6 is not desired, a slit is made in the end of the sleeve to accommodate the protruding end of the artificial nail 1 and the artificial nail 1 is then bonded to the sleeve. Alternatively, the artificial nail may be positioned on the form prior to shrinking the tubing and a suitable adhesive may be applied either to the top surface of the artificial nail or to the inner surface of the tubing prior to shrinking. Of course, other manufacturing sequences and processes may be employed, as will be obvious to those skilled in the art.

As mentioned previously, the sleeve 2 is circumferentially continuous and therefore is not adjustable for fitting fingers of various sizes. The absence of adjustability is an important feature of the invention for it is this aspect that enables the sleeve to fit snugly on the finger and remain securely in place. Unlike prior art picks, the pick of the present invention seldom requires repositioning once it is placed on the finger.

Figure 6:
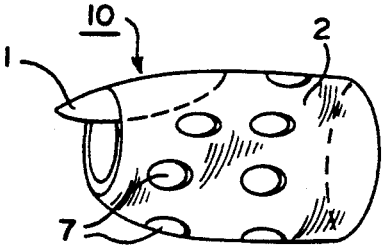
FIG. 6 is a perspective view of a slightly modified form of the pick.

The securement element may be a solid imperforate sleeve, as shown in FIGS. 1-5, or may be a sleeve having a plurality of cutouts or openings dispersed therealong and therearound, as shown at 7 in FIG. 6, to enhance the frictional grip of the sleeve upon the finger. The cutouts or openings are depicted as oval in shape in FIG. 6 but they can be any shape and of any size. The ratio of cutouts to sleeve material is not critical but may vary considerably; and the sleeve may even be formed of a mesh material. Alternatively to cutouts, other forms of gripping mechanisms can be employed. However, the use of cutouts or a mesh material is especially advantageous because the open spaces reduce perspiration of the finger in addition to providing increased gripping effect. Due to the great surface area and flexible material of the sleeve, the pick is snug fitting and offers excellent grip on the finger. This coupled with the direct mating engagement of the picking element with the top surface of the natural nail achieves the optimal sensitivity and natural feel which is so important to the player. Also, the pick of the invention permits the full range of normal mechanical expression and picking motion and allows very forceful playing without dislodgement.

It is thus seen that the pick of the invention represents a great improvement over the picks of the prior art and fully accomplishes all of the objects of the invention enumerated above.

While the invention has been described in specific terms, such should not be considered as limiting its actual scope. Rather, the scope is to be determined by the terms of the appended claims and their legal equivalents, not by the examples set forth above.

Whereas the term "finger" has been employed throughout the above description, it is to be understood that the pick may be utilized on the thumb as well as any of the other fingers. Thus, the term "finger" is intended to include the thumb.

I claim:

1. A pick for use with stringed musical instruments, comprising:

a securement element and a picking element;

said securement element being a circumferentially continuous annular flexible sleeve having a forward end, a rear end, an internal surface extending from said forward end to said rear end, and an external surface extending from said forward end to said rear end;

said picking element being an elongated member having a forward edge, a rear edge, a convex upper surface extending from said forward edge to said rear edge, and a concave lower surface extending from said forward edge to said rear edge;

said picking element extending partially into said sleeve such that said rear edge and a portion of each of said convex upper surface and said concave lower surface lie within said sleeve and such that said forward edge and a portion of each of said convex upper surface and said concave lower surface protrude from said sleeve beyond said forward end of said sleeve;

said portion of said convex upper surface of said picking element which lies within said sleeve being firmly attached to said internal surface of said sleeve; and all of said concave lower surface of said picking element lying within said sleeve and all of said convex lower surface of said picking element protruding from said sleeve beyond said forward end of said sleeve being entirely exposed.

2. The pick as defined in claim 1 wherein said securement element and said picking element are formed of different materials, the material of said picking element being harder than the material of said securement element.

3. The pick as defined in claim 2 where the material of said picking element has a hardness greater than the hardness of a human fingernail.

4. The pick as defined in claim 1 wherein the length of said sleeve from said forward end thereof to said rear end thereof is greater than any diametral measurement of said sleeve and also is greater than the length of said picking element from said forward edge thereof to said rear edge thereof.

5. The pick as defined in claim 1 wherein said rear edge of said picking element lying within said sleeve is spaced forwardly of said rear end of said sleeve.

6. The pick as defined in claim 1 wherein said sleeve has an opening at said forward end and an opening at said rear end, said opening at said forward end being smaller than said opening at said rear end.

7. The pick as defined in claim 1 wherein said sleeve has a plurality of openings dispersed along the length and around the circumference thereof, each of said openings extending entirely through said sleeve from said external surface to said internal surface.

8. The pick as defined in claim 1 wherein said portion of said convex upper surface of said picking element which is firmly attached to said internal surface of said sleeve is bonded to said internal surface of said sleeve.

9. A pick to be worn on a human finger for use in plucking strings of stringed musical instruments, comprising:

an elongated picking element having a forward edge, a rear edge, side edges connecting said forward edge to said rear edge, a convex upper surface extending from said forward edge to said rear edge between said side edges, and a concave lower surface extending from said forward edge to said rear edge between said side edges, said concave lower surface including a portion having a size and shape for mating with and conforming to substantially the entire top surface of the fingernail of said human finger;

a securement element for securing said picking element in place over said top surface of said fingernail of said human finger, said securement element comprising a circumferentially continuous annular flexible sleeve having a length approximately the length of the distal phalange of said human finger and having an external surface, an internal surface, a fingertip end, and an opposite end with an opening of a size to receive said distal phalange of said human finger;

said picking element extending partially into said sleeve such that said rear edge, portions of said side edges, a portion of said convex upper surface, and said portion of said concave lower surface having the size and shape for mating with and conforming to substantially said entire top surface of said fingernail of said human finger lie with said sleeve and such that said forward edge, portions of said side edges, a portion of said convex upper surface, and a portion of said concave lower surface protrude from said sleeve beyond said fingertip end of said sleeve a distance sufficient to permit plucking strings of stringed musical instruments, and to permit trimming and filing to length, as with a human fingernail, when said pick is in place on said distal phalange of said human finger;

said portion of said convex upper surface of said picking element which lies within said sleeve being firmly attached to said internal surface of said sleeve; and said portion of said concave lower surface which has the size and shape for mating with and conforming to substantially said entire top surface of said fingernail of said human finger being entirely exposed for directly contacting substantially said entire top surface of said fingernail of said human finger.

10. The pick as defined in claim 9 wherein said securement element and said picking element are formed of different materials, the material of said picking element being harder than the material of said securement element.

11. The pick as defined in claim 10 wherein the material of said picking element has a hardness greater than the hardness of a human fingernail.

12. The pick as defined in claim 9 wherein said rear edge of said picking element lying within said sleeve is spaced from said opposite end of said sleeve in the direction of said fingertip end of said sleeve.

13. The pick as defined in claim 9 wherein said fingertip end of said sleeve is rounded so as to conform substantially to the shape of the tip of said distal phalange of said human finger and so as to serve as a stop to limit insertion of said distal phalange of said human finger into said sleeve.

14. The pick as defined in claim 13 and further including an opening in said rounded fingertip end of said sleeve for allowing a portion of said tip of said distal phalange of said human finger to be exposed for a tactile reference to increase accuracy and picking control when said pick is in place on said distal phalange of said human finger.

15. The pick as defined in claim 9 wherein said sleeve has a plurality of openings dispersed along the length and around the circumference thereof to enhance frictional grip of said sleeve upon said distal phalange of said human finger when said sleeve is in place thereon and to minimize perspiration of said distal phalange of said human finger when said sleeve is in place thereon, each of said openings extending entirely through said sleeve from said external surface to said internal surface.

16. The pick as defined in claim 9 wherein said circumferentially continuous annular flexible sleeve is formed of a mesh material.

17. The pick as defined in claim 9 wherein said portion of said convex upper surface of aid picking element which is firmly attached to said internal surface of said sleeve is bonded to said internal surface of said sleeve.

* * * * *